United States Patent [19]

Danneels et al.

[11] 4,035,245

[45] July 12, 1977

[54] ELECTROPLATING DEVICE AND METHOD FOR THE PARTIAL METALIZING OF ELEMENTS IN CONTINUOUS TRANSIT

[75] Inventors: Laurent Danneels, Varsenare; Johan Helder; Jan Kuypers, both of Brugge; James Piolon, Ostende, all of Belgium; Wolfgang Pernegger, Erlangen, Germany

[73] Assignee: Siemens Aktiengesellschaft, Berlin & Munich, Germany

[21] Appl. No.: 636,429

[22] Filed: Dec. 1, 1975

[30] Foreign Application Priority Data

Dec. 20, 1974 Germany ..... 2460634

[51] Int. Cl.[2] ..... C25D 5/02; B65G 49/00; C25D 21/10

[52] U.S. Cl. ..... 204/15; 204/202; 204/224 R; 204/273

[58] Field of Search ..... 204/198–205, 204/206, 28, 273, 237, 15, 224 R

[56] References Cited

U.S. PATENT DOCUMENTS

| | | | |
|---|---|---|---|
| 3,507,767 | 4/1970 | Stricker | 204/206 |
| 3,558,455 | 1/1971 | Sorensen et al. | 204/273 |
| 3,573,186 | 3/1971 | Ryerson et al. | 204/198 |
| 3,657,097 | 4/1972 | Baldock et al. | 204/202 |

*Primary Examiner*—T. M. Tufariello
*Attorney, Agent, or Firm*—Hill, Gross, Simpson, Van Santen, Steadman, Chiara & Simpson

[57] ABSTRACT

An electroplating device for partial plating of items in continuous transit through a plating bath. The bath includes an enclosure having slots for movement of the articles to be plated lengthwise of the bath. A cross flow of treatment liquid is maintained in the constant level bath through the provision of flow directing vanes, the flow being provided by a treatment liquid circulation pump.

11 Claims, 4 Drawing Figures

4
6
5
7
8
10
9
123
127
1
26
25
122
23
21
22
24

33
34
30
31
35
32

II
II
6
2
4
3
5
7
8
1
124
126
231
123
23
24
14
20
22
21
121
12
241
127
128
125
11
13
16
15
17
18
19

ELECTROPLATING DEVICE AND METHOD FOR THE PARTIAL METALIZING OF ELEMENTS IN CONTINUOUS TRANSIT

BACKGROUND OF THE INVENTION

1. Field of the Invention

This invention relates to electroplating devices and more particularly to an electroplating bath for plating materials moving in a constant transit through the bath, the bath having an internal fluid flow control vanes.

2. Prior Art

This invention relates to electroplating devices for the partial metalization of items in continuous movement. Such devices having at least one treatment bath which is arranged along the path followed by the items and in which the end walls of the bath are equipped with slots through which the items move with the treatment liquid flowing out of the bath through the slots and being recirculated back to the bath from the delivery side of a circulation pump, are known to the art.

Such continuously operating electroplating devices are shown for example in German Offenlegungsschrift No. 1,796,017. In such devices, the items, for example relay springs and the like, which are to be partially electroplated, are conveyed on a transfer device through a plurality of elongated treatment baths. Only those zones or areas of the items which are to be metalized are actually dipped into the corresponding liquids. In order that the items, in transit, can be passed through the treatment liquids at a constant level, i.e. at a constant penetration depth, the end faces of the treatment baths are provided with slots. The liquid levels in the treatment baths are maintained constant by means of circulation pumps which continuously pump treatment liquids flowing out through the slots back into the corresponding treatment baths. Because of the constant level of treatment liquid within the bath, and because of the constant movement of the itmes are a predetermined penetration depth through that liquid, such prior devices have made possible partial electroplating with the deposition of metal restricted to specific zones or areas. This allows reduction of metal consumption which in turn leads to considerable cost savings, particularly where gold and other valuable metals are involved.

One disadvantage with the prior art, however, arises in that the items treated in such devices may exhibit differing thicknesses of the electro deposited metal layer. The differences in layer thicknesses distribution have often been on the order of 100%. Since, for reliable operation of the electroplated items in use after plating specific deposited layer thickness minimums must be maintained, it would be possible to obtain a further, and substantial, reduction in metal consumption by obtaining a more uniform layer thickness distribution.

SUMMARY OF THE INVENTION

In accordance with the above, it is therefore a primary object of this invention to provide an electroplating device in which the metal deposit applied to at least portions of items in transit through an electroplating bath exhibit minimum deposit layer thickness variations.

According to the teachings of this invention, the primary object is achieved in association with the type of electroplating device above described, wherein the electroplating bath is modified through the provision of bath treatment liquid movement control flow vanes which produce a cross-flow of the treatment liquid circulating in the bath. The term "cross-flow" is herein used to signify that the movement of treatment liquid in the bath cross the path taken by the items being electroplated during their movement in transit through the bath, and that further the flow of treatment liquid crosses that path at least twice with the direction of the flow changing after each crossing of that path of movement of the items.

Because the items being electroplated are exposed to the treatment liquid flow alternately from both their left and right during the items passage through the treatment bath, a more uniform layer thickness distribution of the metalized deposits is achieved. In this manner, it is possible to control the metal deposit on the items to a more uniform degree and therefore, keeping in mind the desired minimum layer thickness, a smaller safety allowance can be utilized. This can result in significant savings.

In the preferred embodiment illustrated, the flow vanes within the treatment bath will be aligned perpendicularly to the path followed by the items being electroplated. In the illustrated embodiment, the flow vanes are disposed in two rows which are centrally offset in relation to one another. By this disposition of the flow vanes the treatment liquid in the bath will follow a serpentine passage. By this means, the flow and therefore the uniformity of electro depositation will be further improved. Additionally, by maintaining the interval between the neighboring flow vanes of at least 50 mm and at most 300 mm particularly good flow and depositation conditions will be obtained.

In the preferred embodiment the height of the flow vanes corresponds to at least the level of the treatment liquid. In such a construction, the flow vanes are provided with openings, or slots, in the immediate neighborhood of the path of the items to be electroplated, however, by maintaining the height of the flow vanes submerged in the liquid at least to the level of the liquid, it is assured that the flow of the treatment liquid will be guided in the surface zone. The openings which are provided through the flow vanes to pass the items in transit, will be easily bridged by the flow.

Advantageously, at least parts of the flow vanes will terminate in spaced relation to the side walls of the treatment bath. In this manner, the anodes may then be inserted into the treatment liquid in the form of continuous plates which may extend along the side walls.

Additionally, in the preferred embodiment of this invention, the delivery line from the circulation pump will open into the central area of the treatment bath where it will be operatively associated with a deflector element whose exit orifice is directed perpendicularly towards at least one of the side walls of the bath. Thus, the treatment liquid flowing into the treatment bath will be split into two flows, each of which will terminate through one of the end wall slots provided for transit of the items to be metalized. Because of the alignment of the deflector element perpendicularly to the path followed by the items in transit, the cross-flow pattern of the fluid flow will be reinforced. Preferentially, the deflector element can be constructed as an elongated hollow rib attached to the bottom of the treatment bath. In addition to its function as a deflector, such a hollow rib can provide a secure base for the mechanical attachment of the flow vanes.

It is therefore an object of this invention to provide an electroplating device for the metalizing of items in continuous transit through an electroplating bath, the bath consisting of a member having end walls with slots for movement of the items to be metalized, a continuous flow of treatment liquid being provided to the bath, internal flow directing vanes positioned within the bath creating a cross-flow of treatment liquid within the bath, and the flow being perpendicular to the movement of the items through the bath.

It is another and more particular object of this invention to provide a treatment bath for electroplating items in continuous transit of the bath, the bath having end walls with slots therethrough through which the items to be electroplated move, the bath having a plurality of treatment liquid flow control vanes positioned therein, the bath being provided with a continuous flow of treatment liquid, the flow vanes causing said liquid to move through the bath in a serpentine fashion having portions of the flow being directed approximately at right angles to movement of the items to be metalized through the bath.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 2:
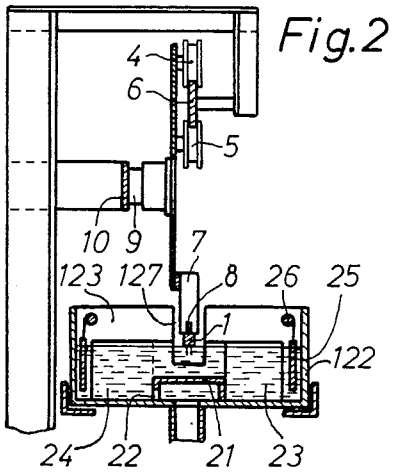
FIG. 2 is a fragmentary cross sectional view taken along the lines II—II of FIG. 1.
Figure 1:
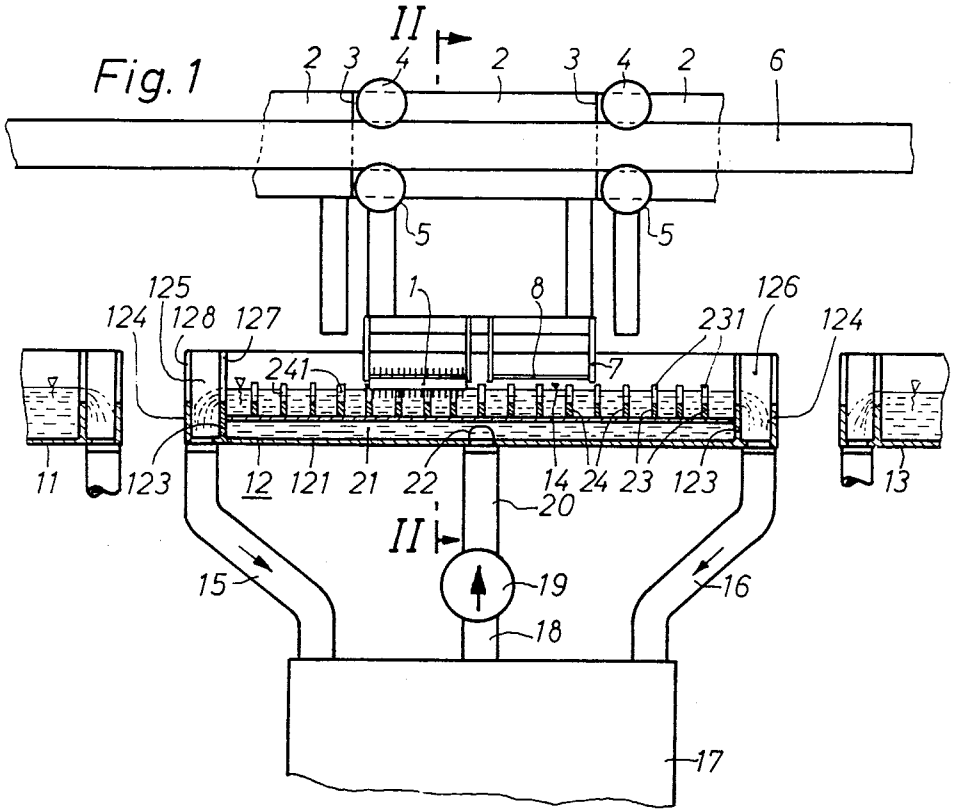
FIG. 1 is a longitudinal diagrammatic cross section of portions of an electroplating device according to this invention.

FIGS. 1 and 2 illustrate an electroplating device for the partial plating of two row pin strips, FIG. 1 showing the device in longitudinal section and FIG. 2 in cross section. The individual pin strips are suspended from a transfer and contacting device and move at constant speed and constant level through several pre-treatment and electroplating baths. Only that part of the individual pins of the pin rows which is to be plated is emersed in the particular treatment liquids. The transfer and contacting device consists of transfer carriages 2 which are attached by hinge driving means 3 to an endless transfer chain. The drive to the transfer chain, not shown in the drawing, can, for example, be through a polygonal wheel whose edge length is matched to the length of the transfer carriages 2.

Each of the transfer carriages 2 is gilded on a rail 6 by means of rollers 4 and 5 and, is further equipped with a pin strip holder 7 designed to receive two pin strips 1.

Because, in order to provide for the electroplating, each individual pins has to be in electrical contact, the pin strip holders 7 are provided with contact bars 8 constructed of corrosion resistant material. The contact bars 8 have a diameter slightly larger than the interval between the two pin rows on each strip 1. The correct electrical contact for the individual pins and the attachment and positioning of the pin strips 1 are commonly effected at the time of loading of the pin strip due to the clamping action developed between the two pin rows and the intervening contact bar 8. To further the electrical contact circuit, the pin strip holders 7 are conductively connected to one another and to earth via the intermediary of carbon brushes 9 and a current busbar 10.

The succession of pretreatment and electroplating baths which the pin strips pass through are in the form of elongated tubs. Successive baths 11, 12, and 13 may be provided with only the bath 12 being fully shown. Because the baths are similar in design, the following description will make reference to the bath 12, however, it being understood that a plurality of such baths may be provided. The bath 12 may be an electroplating bath in which a treating liquid 14, for example a gold electrolyte is provided.

The treatment bath 12 consists of a base 121 having two opposed side walls 122 and two opposed end walls 123. The base 121 and the side walls 122 both project longitudinally beyond the end walls 123 and may terminate in two opposite disposed additional end walls 124. The provision of the end walls 124 provides overflow chambers 125 and 126 beyond the end walls 123. In order for the pin strips 1 to be passed through the treatment bath 12 at a constant level, the two end walls 123 have centrally disposed transit slots 127 which give free passage to the items being electroplated. Similar openings 128 are formed in the two end walls 124 of the overflow chambers 125 and 126. Because the slots 127 extend below the surface of the treatment liquid 14, the liquid continuously flows into the overflow chambers 125 and 126. Drain lines 15 and 16 communicate the overflow chambers 125 and 126 to a reservoir and buffer vessel 17 and direct the liquid flow to the vessel.

To maintain the liquid in the treatment bath 12 at a constant level, the treatment liquid 14 is continuously pumped via a suction line 18 from the reservoir 17 to a variably delivery circulation pump 19 which discharges to a delivery line 20 terminating interiorly of the treatment bath 12. The delivery line 20 preferably opens centrally from below the treatment bath through the base 121 where it discharges to the interior of a hollow, inverted "U" shaped cross section rib member 21 which is affixed to the base 21 to form a rectangular channel.

The treatment liquid 14 which has been pumped to the interior of the rib 21 will then flow through a discharge opening 22 to the interior of the bath 12 where it will be split into 2 flows which eventually pass through the slots 127 into the overflow chambers 125 and 126 and then back to the reservoir 17 to complete the treatment liquid flow circuit.

The path of the two sub-flows is governed by flow vanes 23 and 24 in such a fashion that a serpentine cross-flow pattern is produced within the treatment bath 12.

The flow vanes 23 and 24 are attached to the base 121 of the treatment bath 12 and/or to the hollow rib 21. The flow vanes 23 and 24 contain openings 231 and 241 best shown in FIG. 3. These openings permit transit of the items to be electroplated through the bath and are aligned with the slots 127. The vanes 23 and 24 preferably have side edges terminating in spaced relation to the side walls 122 of the treatment bath thereby providing space for insertion of plate-like anodes 25 which can be suspended from anode rod 26 into the treatment liquid adjacent the sides 122.

Figure 3:
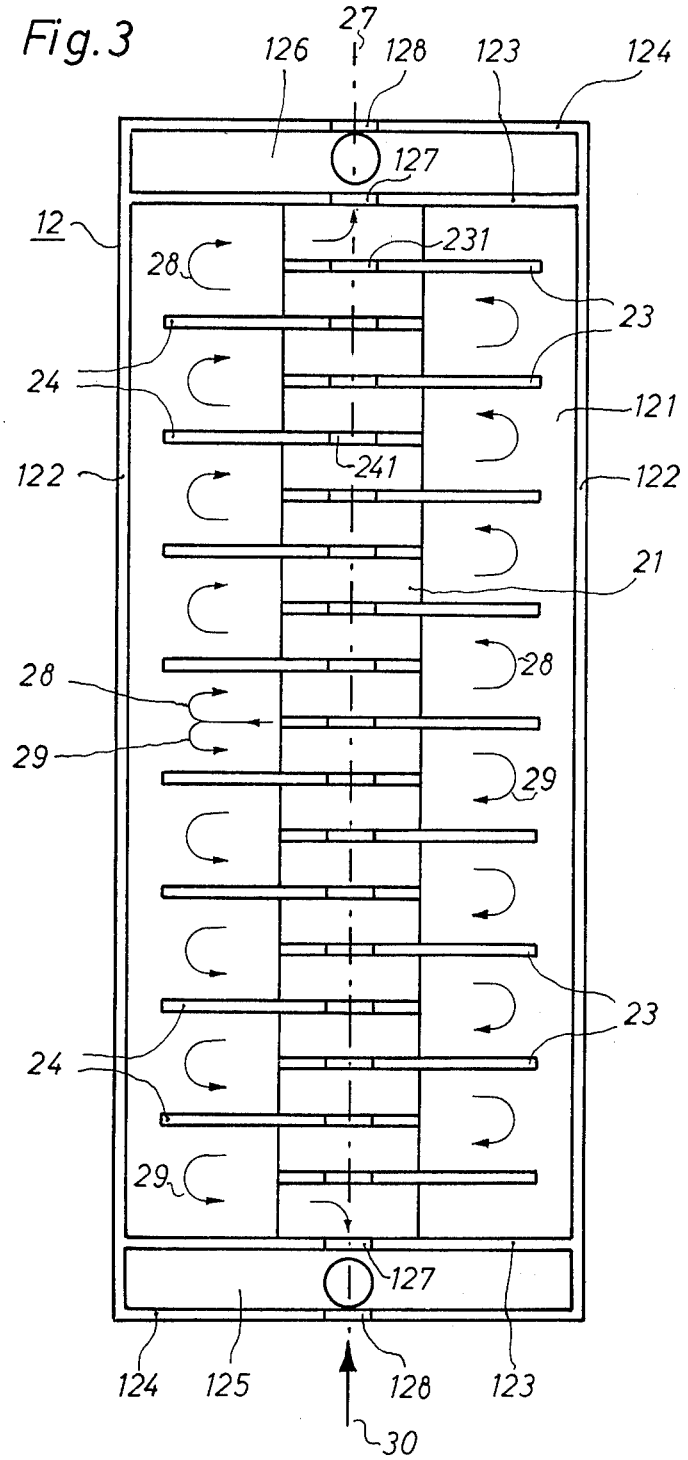
FIG. 3 is a top plan view of the electroplating treatment bath of this invention.

FIG. 3 illustrates the arrangement of the flow vanes 23 and 24 and the flow paths created thereby. The figure is enlarged to approximately twice the scale of FIGS. 1 and 2. The flow vanes 23 and 24 are constructed of materials compatible with the bath liquid, for example from polypropylene. The vanes are aligned perpendicularly to the path of the items to be plated as they move through the bath as illustrated by the broken line 27 and are arranged in two rows which are centrally staggered vis-a-vis one another as illustrated. The flow vanes 23 in one row and the vane 24 in the other overlap one another in the zone of the path followed by the items in transit so that the two sub-flows of treatment liquid follow serpentine paths. The overlap between the two rows, corresponding in the illustrated case to the width of the rib 21 should not exceed approximately 40% of the free width of the bath, in order to keep the flow losses to an acceptable limit. Similarly, the interval between two neighboring flow vanes 23 and 24 in a row, should be in the order of 50 mm to 300 mm. In this way, the flow resistance is kept at such a low level that no unwanted differences in liquid level in the bath are created between the center of the bath and the ends thereof. In the present instance, with a free bath length of 1,000 mm, and a free width of 250 mm, the overlap between the two rows is set at 100 mm, in one row there being nine flow vanes 23 and in the other row eight flow vanes 24. The serpentine cross-flow created by the two sub-flows of treatment liquid 14 from the discharge of the hollow rib 21 to the end slots 127 is illustrated by arrows 28 and 29 with the arrow 30 illustrating the direction of movement of the items to metalized, for example a pin strip which may be transported at a speed of 0.5 meters per minute through the bath 12. As the illustration illustrates, the pin strip 1 will alternately receive the flow of liquid from left and right on its way along the path 27. In this manner uniform layer thickness distribution of the electro-deposited gold will be substantially achieved.

Figure 4:
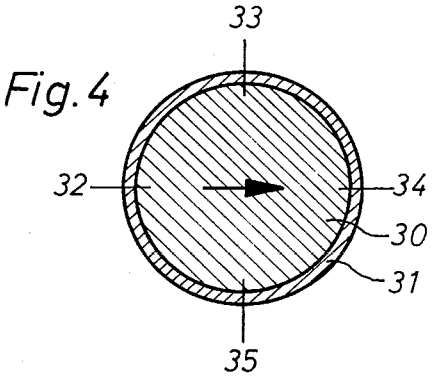
FIG. 4, on the first page of drawings, is a greatly enlarged cross section view of a pin electroplated in the device according to this invention.

FIG. 4 is a greatly enlarged illustration of a cross section of a pin 30, such as from a pin strip, partially gilded in the above described electroplating device. The pin 30 has a gold layer 31 whose thickness is illustrated but now shown to a scale in relation to the diameter of the pin. The references 32 through 35 indicate measurement locations at which the thickness of the gold layer 31 has been determined. The following table indicates the values obtained. By way of comparison, the table also gives corresponding figures for a pin which has been gilded in an electroplating device not equipped with flow vanes.

| | Gold Layer Thickness (microns) | | | |
|---|---|---|---|---|
| | Measurement location 32 | Measurement location 33 | Measurement location 34 | Measurement location 35 |
| Electroplating device with flow vanes | 2.15 | 2.10 | 2.10 | 2.20 |
| Electroplating device without flow vanes | 1.40 | 2.40 | 2.80 | 2.20 |

As the table shows, the layer thickness differences in the gold layer 31 applied using an electroplating device in accordance with the invention, are virtually negligible, while the thickness fluctuations in a gold layer applied to a conventional electroplating device may be on the order of as much as 100%. In the illustrated example, the ungilded pin 31 had a diameter of 1 mm. At the measurement locations 33 and 35 which correspond with the contact locations in a plug-in connection, layer thicknesses of 2.2 microns were desired. This desired layer thickness consists of a minimum layer thickness of 2.0 microns which is required for proper operation, and an allowance of 0.2 microns provided as a safety factor. The direction of movement of the pin 31, as indicated in FIG. 4 by an unmarked arrow, that is to say, the direction which it moves during electroplating, has no influence upon the layer thickness distribution of the gold deposit in the electroplating device in accordance with the invention. On the other hand, in an electroplating device without flow vanes, the movement direction is critical in determining the layer thickness distribution, the maximum layer thickness occurring at a position corresponding to the measurement location 34.

It can therefore be seen from the above that our invention provides a novel device for electroplating items in continuous motion through an electroplating bath. The bath consists of an open top housing device with central slots therethrough for passage of the items to be electroplated in continuous motion at a continuous level, the bath having a treatment liquid continuously supplied thereto, and the bath being equipped with liquid flow direction determining vane which impart a serpentine flow to the liquid in the bath.

Although the teaching of our invention have herein been discussed with reference to specific theories and embodiments, it is to be understood that these are by way of illustration only and that others may wish to utilize our invention in different designs or applications.

We claim as our invention:

1. In an electroplating device for the partial coating of items in continuous motion including at least one treatment bath positioned along the path followed by the items, the treatment bath having end walls containing slot openings therethrough to pass the items at a constant level, the bath having a treatment liquid therein flowing out of the bath through the slots and being resupplied to the bath via a circulation pump, the improvement of the treatment bath having liquid flow direction control vanes therein, the vanes effective to produce a cross-flow of the circulation treatment liquid within the bath, said cross-flow crossing the path followed by the items at least twice and in opposite directions.

2. The improvement of claim 1 wherein the flow vanes are positioned perpendicularly to the path followed by the items moving though the bath and are disposed in two rows of vanes, the rows being centrally offset from one another.

3. The improvement of claim 2 wherein the interval between neighboring flow vanes in a row is equal to or greater than 50 mm and equal or less than 300 mm.

4. The improvement of claim 2 wherein the flow vanes have a height at least equal to the normal level of treatment liquid in the bath, the flow vanes being provided with slot openings therethrough for passage of the items being coated.

5. The improvement of claim 2 wherein the flow vanes have end walls terminating for at least a portion of their height in spaced relation to side walls of the bath.

6. The improvement of claim 1 wherein the pump discharges to a central area of the bath, a deflector element positioned in said bath deflecting the discharge from the pump towards at least one side wall of the bath in substantially perpendicular relationship thereto.

7. The improvement of claim 6 wherein the deflector element constitutes an elongated hollow member attached to a base of the treatment bath.

8. An electroplating device comprising: an electroplating bath having side and end walls and a bottom wall, slot openings in said end walls providing access to the interior of the bath for items to be electroplated, said items moving at a constant level with respect to the bath, a treatment liquid in said bath, said treatment liquid flowing out of said bath through said slots, means recirculating said liquid to the interior of said bath, liquid circulation flow blocking vanes in said bath directing the flow of liquid from a liquid inlet to said bath to said slot openings and said vanes effective to create a serpentine flow of liquid in said bath.

9. The device of claim 8 wherein the vanes are positioned within said bath at substantially right angles to a direction of movement of items to be treated in said bath.

10. The device of claim 9 wherein the vanes have top portions thereof positioned at least at a normal level of treatment liquid within the bath.

11. The method of metalizing items in an electrodeposition bath comprising: providing a bath having side walls, end walls and a bottom, providing slot openings through two opposed walls of said bath, the slot openings being aligned with one another, introducing items to be metalized to said bath through one of said slot openings and continuously moving said items through said bath and through the slot opening in the opposed wall from the entrance, supplying a continuous flow of treatment liquid to said bath, through a flow inlet sufficient to provide a liquid level in the bath, maintaining the flow at a level above a bottom of said slots, discharging said flow through said slots, and maintaining a serpentine movement of said flow within said bath from a flow inlet thereto to the said slots.

* * * * *